US007407253B2

(12) United States Patent
Yokoyama et al.

(10) Patent No.: US 7,407,253 B2
(45) Date of Patent: Aug. 5, 2008

(54) INKJET RECORDING APPARATUS

(75) Inventors: Takeshi Yokoyama, Hachioji (JP); Koji Matsushima, Akishima (JP)

(73) Assignee: Konica Minolta Medical & Graphic Inc., Tokyo (JP)

( * ) Notice: Subject to any disclaimer, the term of this patent is extended or adjusted under 35 U.S.C. 154(b) by 448 days.

(21) Appl. No.: 11/121,713

(22) Filed: May 3, 2005

(65) Prior Publication Data

US 2005/0253913 A1 Nov. 17, 2005

(30) Foreign Application Priority Data

May 14, 2004 (JP) ..... 2004-144883

(51) Int. Cl.
*B41J 29/38* (2006.01)
*B41J 29/393* (2006.01)
*B41J 2/01* (2006.01)

(52) U.S. Cl. ..... 347/19; 347/17; 347/102

(58) Field of Classification Search ..... 347/17–19, 347/100–102

See application file for complete search history.

(56) References Cited

U.S. PATENT DOCUMENTS 6,211,265 B1 * 4/2001 Ohta et al. ..... 523/160
2003/0227527 A1 * 12/2003 Richards ..... 347/102
2004/0145642 A1 * 7/2004 Hoshino et al. ..... 347/102
2005/0018026 A1 * 1/2005 Nerad et al. ..... 347/102
2006/0146109 A1 * 7/2006 Goodyer ..... 347/102

FOREIGN PATENT DOCUMENTS

JP 2003-145725 A 5/2003

* cited by examiner

*Primary Examiner*—Manish S. Shah
*Assistant Examiner*—Mark J Stevenosky, Jr.
(74) *Attorney, Agent, or Firm*—Frishauf, Holtz, Goodman & Chick, P.C.

(57) ABSTRACT

An inkjet recording apparatus includes a recording head formed with nozzles for jetting light curable ink onto a recording medium, a light irradiator having a light source for emitting light to cure the ink, and an illuminance detecting device for intermittently detecting an illuminance of the light emitted from the light source, at a predetermined interval. The inkjet recording apparatus further includes a temperature adjusting device for adjusting a temperature of the light source, and a control section for determining that the ink cannot be cured, if the illuminance detected by the illuminance detecting device is not higher than a reference value in a condition where the temperature of the light source has been adjusted into a predetermined range by the temperature adjusting device.

9 Claims, 6 Drawing Sheets

INKJET RECORDING APPARATUS

This application is based on Japanese Patent Application No. 2004-144883 filed on May 14, 2004, in Japanese Patent Office, the entire content of which is hereby incorporated by reference.

FIELD OF THE INVENTION

The present invention relates to an inkjet recording apparatus, and particularly, to an inkjet recording apparatus by which an image is recorded with photo-curable type ink which is cured by irradiating the light.

BACKGROUND OF THE INVENTION

Recently, compared to a system which is necessary for plate making, such as a gravure printing system or flexographic printing system, inkjet recording apparatuses are widely used, because an image can be formed simply and at a lower cost.

In a field in which the image recording is conducted on goods or packaging by using an inkjet recording apparatus, there are many cases where materials having no ink absorptivity such as resin or metal are used. There is known an inkjet recording apparatus (for example, refer to Patent Document 1) which fixes ink on such a recording medium having no ink absorptivity, and has a recording head provided with nozzles for ejecting ink which is cured by irradiating light such as ultraviolet ray, and a light irradiating device provided with a light source for generating light for curing ink. In this apparatus, after ink ejected from the nozzle lands on the recording medium, the ink is cured by irradiating light onto this recording medium with the light irradiating device, and thus an image is formed.

Herein, if a time period from when the ink is impacted on the recording medium until when the light is irradiated is long, the dot diameter of the ink impacted on the recording medium is enlarged and bleeding or color mixture is caused, and the image quality drops. Accordingly, to reduce a time period from when the ink is impacted on the recording medium until when the light is irradiated, in a known inkjet recording apparatus, a light irradiating device is provided close to a recording head. Consequently, in order to prevent ink adhered to the surface with nozzles from being cured by light having been emitted from the light source and reached the nozzle formed surface of the recording head, the light irradiating device is provided with a cover member to cover the light source.

Further, in an inkjet recording apparatus which cures ink by using a light irradiating device, when illuminance of light emitted from a light source drops equal to or lower than a value by which ink can be well cured, due to the deterioration of the light source, ink ejected from the recording head and impacted on a recording medium is not well cured, and the image quality drops. Therefore, it is proposed that the illuminance of the light emitted from the power source be detected and when it drops equal to or lower than the reference value, the drop in the illuminance be reported to the user by a device which displays the drop on a display unit, or image recording be prohibited.

Hereupon, recently, cation curable ink has been proposed, which is an energy accumulation type that can be cured if it is irradiated for a long period of time even with a low illuminant light. In order to cure this cation curable type ink, a low electric power and low output ultraviolet light source such as a low pressure mercury lamp, cold cathode ray tube can be used.

[Patent Document 1] Tokkai No. 2003-145725

However, because, particularly in a low output type light source, the light emitting efficiency has a characteristic of changing with the temperature of a base part discharging electricity in the light source, or changing with the temperature difference between the light emitting tube and the base part. Accordingly, when the temperature inside a cover member rises due to heat generation of the light source and the temperatures of the base part and light emitting tube change, the light emitting efficiency of the light source changes. Accordingly, it is necessary to detect the illuminance of light emitted by the light source and confirm if the illuminance is high enough prior to starting image recording. After the light is turned on, the illuminance of light emitted by the light source rises for a certain time with a rise in the temperature of the light source, and then stabilizes. The time taken for stabilization of the illuminance is effected by the environmental temperature, the light time, and the time from when the light was turned off last time until the light was turned on this time. Accordingly, the time taken for stabilization of the illuminance depends on use environment of the apparatus in use, which causes a problem of detecting the illuminance before the illuminance stabilizes, or detecting the illuminance after a time longer than necessary has elapsed.

Further, when illuminance of light emitted from the light source is detected for evaluation and if the illuminance becomes equal to or lower than the reference value, this status is reported to the user, or image recording is prohibited. Then, the user is required to determine whether the drop in the illuminance is due to the life of the light source or due to drop in the light emitting efficiency, and take a necessary step, which causes a problem of placing a load on the user.

Accordingly, to solve a problem as described above, a first object of the invention is to provide an inkjet recording apparatus having a device that intermittently detects illuminance of a light source, calculates the illuminance-change-rate, and determines that the illuminace of the light source has stabilized, namely, has come to a peak, when the illuminance-change-rate has come into a predetermined range.

To solve another problem as described above, a second object of the invention is to provide an inkjet recording apparatus which maintains an optimum light emitting efficiency of a light source, and correctly determines the life of the light source so as to cure ink always well by emitting a proper amount of light, without placing a load on the user, thus providing high quality images.

SUMMARY OF THE INVENTION

In a first aspect of the invention, to attain the first object mentioned above, an inkjet recording apparatus includes a recording head formed with nozzles for jetting light curable ink onto a recording medium, a light irradiator having a light source for emitting light to cure the ink, and an illuminance detecting device for intermittently detecting the illuminance of the light emitted from the light source, at a predetermined interval.

In a second aspect of the invention, to attain the second object mentioned above, an inkjet recording apparatus includes a recording head formed with nozzles for jetting light curable ink onto a recording medium, a light irradiator having a light source for emitting light to cure the ink, a temperature adjusting device for adjusting the temperature of the light source, an illuminance detecting device for detecting the illuminance of the light emitted by the light source, and a control section for determining that the ink cannot be cured if the illuminance detected by the illuminance detecting device is equal to or lower than a reference value in a condition where the temperature of the light source has been adjusted into a predetermined range by the temperature adjusting device.

In a third aspect of the invention, the inkjet recording apparatus in the above stated first aspect of the invention further includes a temperature adjusting device for adjusting a temperature of the light source, and a control section for determining that the ink cannot be cured, if the illuminance detected by the illuminance detecting device is equal to or lower than a reference value in a condition where the temperature of the light source has been adjusted into a predetermined range by the temperature adjusting device.

BRIEF DESCRIPTION OF A PREFERRED EMBODIMENT

DETAILED DESCRIPTION OF PREFERRED EMBODIMENT

A preferred embodiment of the present invention will be described below, referring to FIGS. 1 to 6.

Figure 1:
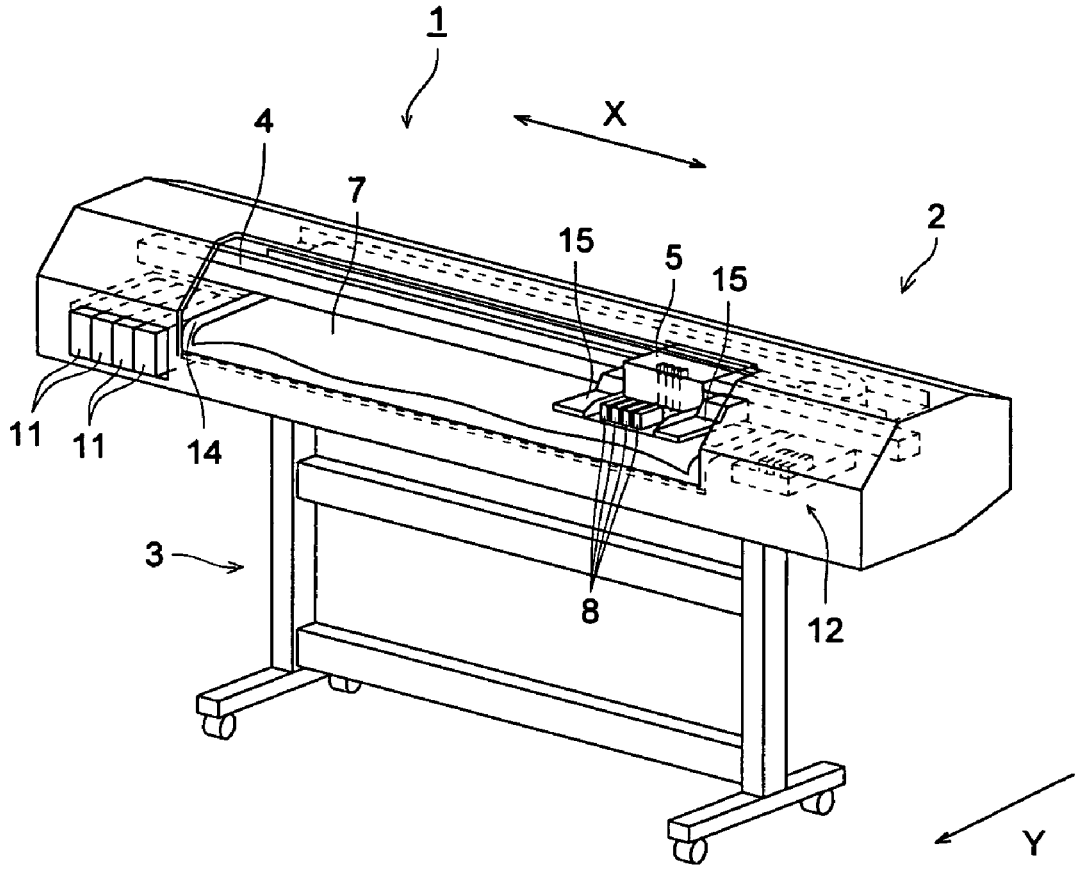
FIG. 1 is a perspective view showing a structure of one embodiment of an inkjet recording apparatus according to the present invention.

An inkjet recording apparatus according to the present embodiment is a serial head type inkjet recording apparatus 1. The inkjet recording apparatus 1 is provided with, as shown in FIG. 1, a printer main body 2 and a support base 3 for supporting the printer main body 2. In the printer main body 2, a bar-like guide rail 4 is provided, and by this guide rail 4, a carriage 5 is supported. This carriage 5 is structured in such a manner that it is reciprocally moved along the guide rail 4 in the main scanning direction X by a carriage drive mechanism 6 (refer to FIG. 6).

Figure 2:
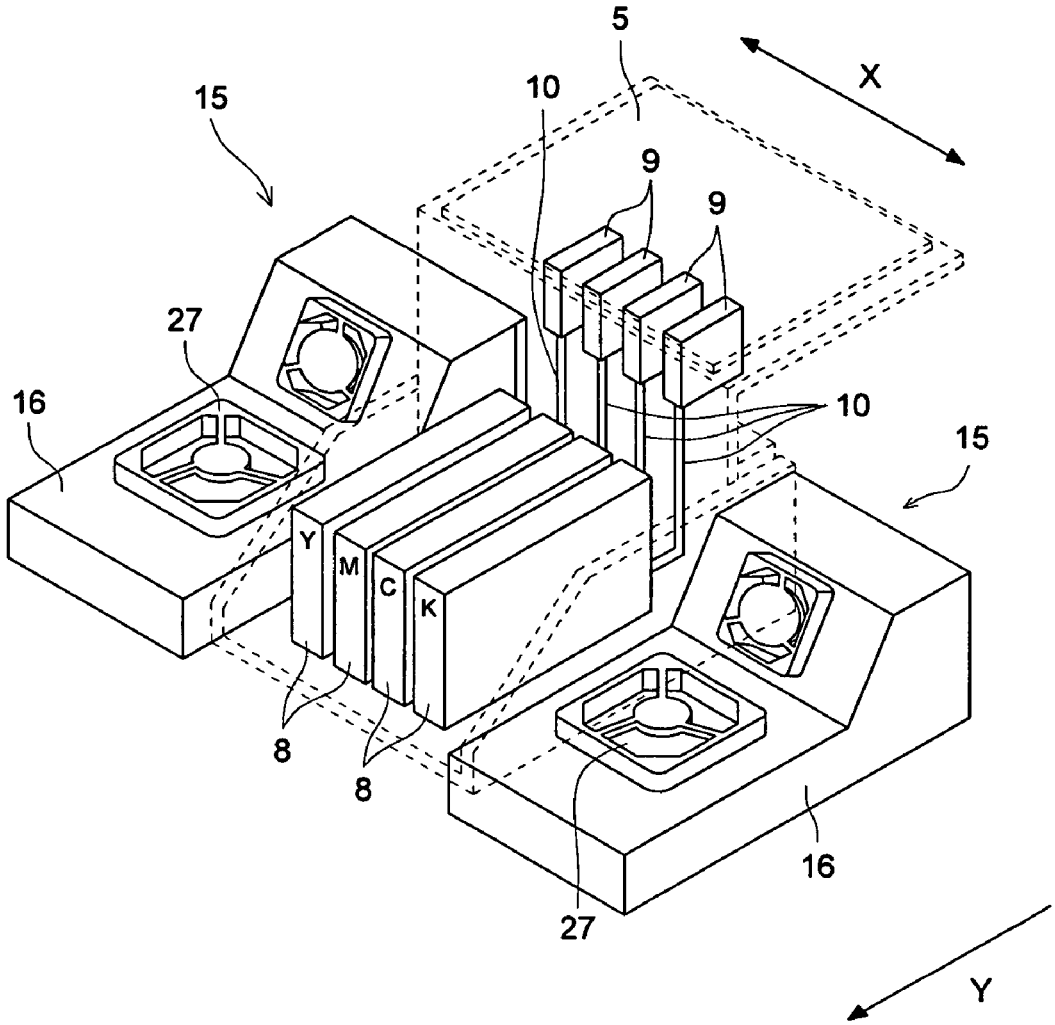
FIG. 2 is a perspective view showing a structure of a carriage and an ultraviolet ray irradiating device which are provided in the inkjet recording apparatus in FIG. 1.

On the carriage 5, as shown in FIG. 1 and FIG. 2, recording heads 8 provided with nozzles (not shown) which eject respective color inks of yellow (Y), magenta (M), cyan (C), black (K), to a recording medium 7, are mounted. To each recording head 8, an intermediate tank 9 for storing each color ink is communicated through an ink supply tube 10.

Hereupon, the ink used in the present embodiment is an ultraviolet ray curable type ink, which is cured by irradiating ultraviolet ray. As polymerizable compounds, ultraviolet ray curable type inks can be roughly categorized into radical polymerizable inks containing a radical polymerizable compound, and cation polymerizable inks containing a cation polymerizable compound. Herein, in energy accumulation type cation polymerizable inks, polymerization reaction is less inhibited by oxygen. Further, energy accumulation type cation polymerizable inks can be cured even with low illuminance ultraviolet ray, if irradiated for a long period of time. Therefore, energy accumulation type cation polymerizable inks are preferably used.

Further, as a recording medium 7, recording media formed of a material including various kinds of papers such as plain paper, regenerated paper, and glossy paper, various kinds of clothes, non-woven fabrics, resins, metals, glasses, can be used. Particularly, as the recording medium 7 used in the present embodiment, a transparent or opaque non-absorptive resin-made film used for so-called packaging, can be applied.

A central part of the movable range of the carriage 5 is, as shown in FIG. 1, a recording area to perform recording on the recording medium 7. At one end of the outside of the recording area which is in the movable range of the carriage 5, through ink supply paths not shown, provided are ink supply units 11 for supplying ink to the intermediate tanks 9 mounted on the carriage 5. Further, at the other end of the outside of the recording area which is in the movable range of the carriage 5, provided is a maintenance unit 12 for cleaning the recording heads 8.

Further, in the printer main body 2, there is provided a conveying mechanism 13 (refer to FIG. 6) for conveying the recording medium 7 in sub-scanning direction Y perpendicular to main scanning direction X. The conveying device 13 is provided with, for example, a conveying motor and conveying roller which are not shown, and is structured in such a manner that, when the conveying roller is rotated by driving the conveying motor, the recording medium 7 is conveyed in the sub-scanning direction Y. Further, the conveying device 13 is structured in such a manner that, conveyance and stoppage of the recording medium 7 are repeated in synchronization with the movement of the carriage 5 during image recording, and thus the recording medium 7 is intermittently conveyed.

Further, in the recording area below the carriage 5, a platen 14 for supporting the recording medium 7 from the non-recording surface is provided. This platen 14 is structured by a plate-like member.

On both-side parts in the main scanning direction X of the recording heads 8, there is provided an ultraviolet ray irradiation device 15 as a light irradiation device which irradiates ultraviolet ray onto ink ejected from the nozzles onto the recording medium 7 to cure the ink.

Figure 3:
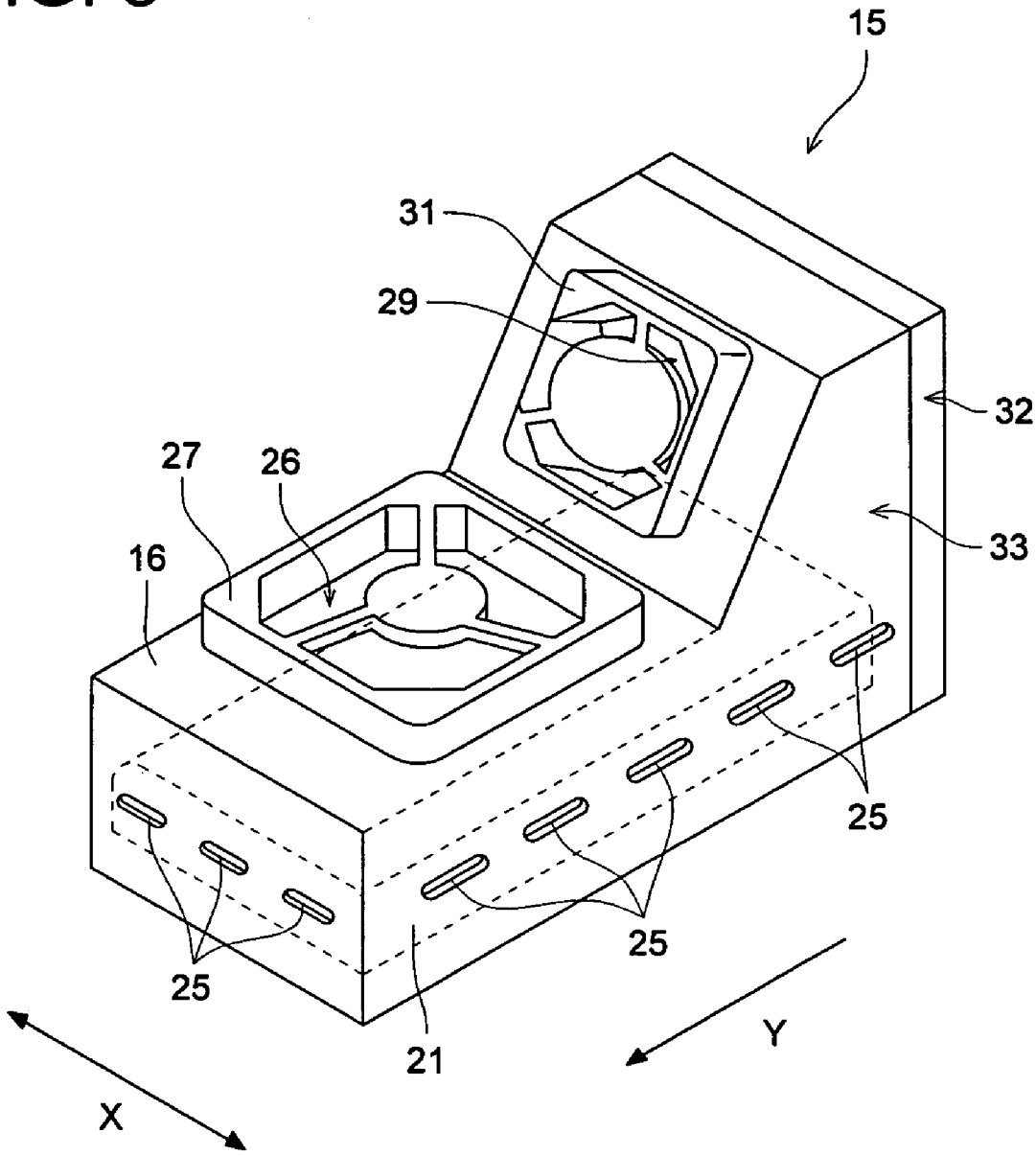
FIG. 3 is a perspective view from above, showing the structure of the ultraviolet ray irradiating device provided in the inkjet recording apparatus in FIG. 1.
Figure 4:
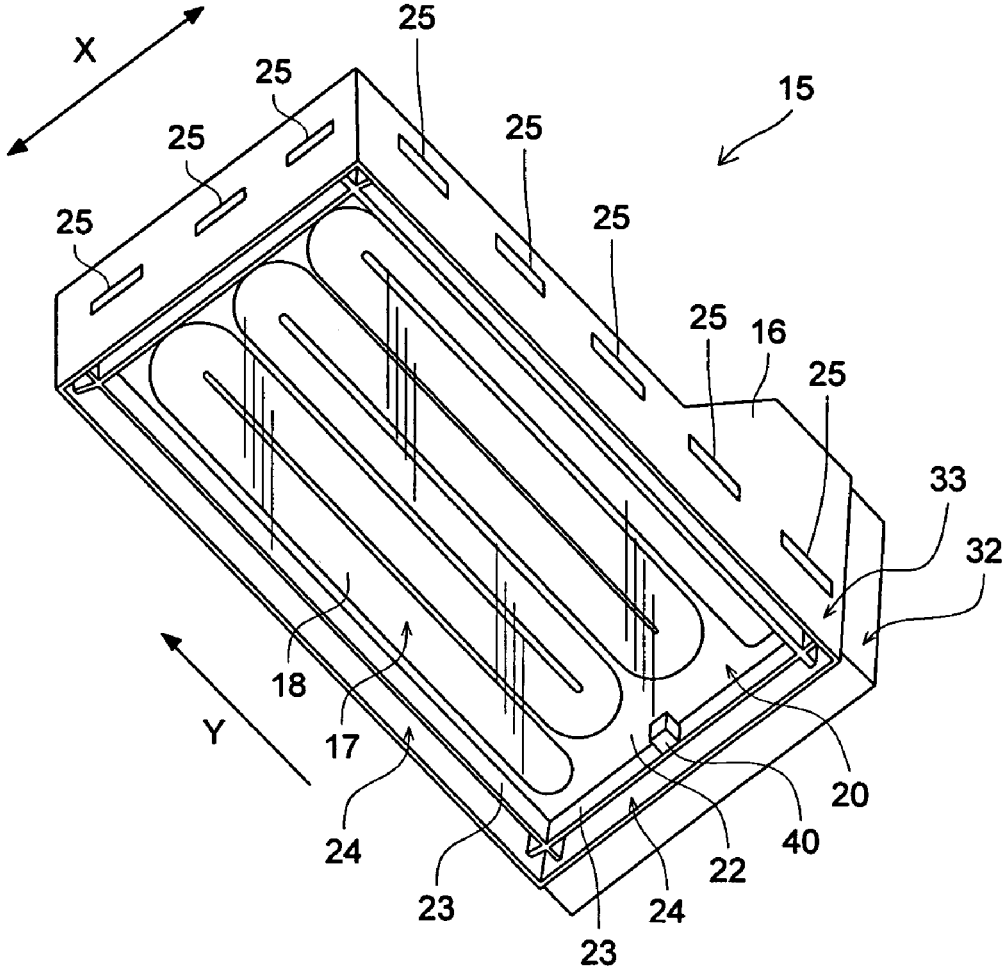
FIG. 4 is a perspective view from below, showing the structure of the ultraviolet ray irradiating device provided in the inkjet recording apparatus of FIG. 1.

The ultraviolet ray irradiation device 15 is, as shown in FIG. 2 and FIG. 3, a box type which opens toward the recording medium 7 side, and has a cover member 16 which has an end part, on the upstream side in the sub-scanning direction, protruded upward, and inside this cover member 16, as shown in FIG. 4, is provided a low pressure mercury lamp 17, as a light source for emitting ultraviolet ray for curing the ink. Hereupon, not limited to the low pressure mercury lamp 17, a low output type light source including a black light, a cold cathode ray tube can be applied as the light source.

The low pressure mercury lamp 17 includes, as shown in FIG. 4, a light emitting tube 18 which is provided along the sub-scanning direction Y and bent at a predetermined length, and a cylindrical base part 19 (refer to FIG. 5) which is fitted to both ends of the light emitting tube 18, extending upward along the protrusively formed part of the cover member 16. When electric current flows through the base part 19, the light emitting tube 18 emits light. Hereupon, the shape of the light emitting tube 18 of the low pressure mercury lamp 17 is not limited to the tube shown in FIG. 4. For example, it is possible to use a tube of a structure in which base parts 19 are fitted at both ends of the U-shaped light emitting tube.

On a light emitting tube housing part 20 (refer to FIG. 4) in which the light emitting tube 18 is housed in the cover member 16, a reflection member 21 (refer to FIG. 3) for reflecting ultraviolet ray, which is irradiated from the light source 15 and is diffused, to the recording medium 7 is provided to cover the light emitting tube 18. As the reflection member 21, applied is, for example, a high purity aluminum-made reflection plate which effectively reflects ultraviolet ray over the entire wavelength range. Particularly, a cold mirror (glass molded plate) is preferable, which is made in such a manner that a thin film of a metallic compound mainly containing aluminum is evaporated on a glass surface. While such a cold mirror effectively reflects ultraviolet ray, it transmits visible ray of light and infrared ray behind the mirror, thereby reducing the drop in light emitting efficiency due to the heat generation of the light source.

Below the light emitting tube housing part 20, to prevent dirt such as ink-mist from adhering to the light source, and to prevent the recording member 7 from coming into contact with the light emitting tube 18 when the recording medium 7 is floated from the platen due to a conveying fault, a protective member 22 is provided and supported by a bar-like supporting member 23 fitted to the cover member 16. A gap 24 is provided between this supporting member 23 and the side surface of the cover member 16. The protective member 22 is formed into a plate-like by a material such as transparent glass or transparent resin, which has an ultraviolet ray penetrability, and the protective member 22 is replaceable.

Further, in a part which is in the vicinity of the light emitting tube 18 and is at one end of the protective member 22, there is provided an illuminance sensor 40 as an illuminance detecting device for detecting the illuminance of light emitted from the light emitting tube 18.

A plurality of outside air intake ports 25 (refer to FIGS. 3 to 5) are provided through each side surface of the cover member 16 corresponding to the light emitting tube housing part 20, and an exhaust port 26 (refer to FIGS. 3 to 5) is provided on the upper surface of the cover member 16 corresponding to the light emitting tube housing part 20, to exhaust air from the light emitting tube housing part 20. A light emitting tube cooling fan 27 is arranged at a position which is on the upper surface of the cover member 16 and corresponding to the exhaust port 26, as a light emitting tube temperature adjusting device. The light emitting tube cooling fan 27 rotates to take in the outside air from the outside air intake ports 25 and from a gap 24 between the supporting member 23 and the cover member 16, and to exhaust the air from the exhaust port 26. Thus, the heat generated from the light emitting tube 18 is released, and the light emitting tube 18 is cooled.

Further, the protrusively formed part of the cover member 16 is a base housing part 28 (refer to FIG. 5) in which the base parts 19 are housed. An outside air feeding port 29 is provided through the side surface on the downstream side in the sub-scanning direction Y of the base housing part 28 to feed the outside air into the base housing part 28. On the side surface on the upstream side in the sub-scanning direction Y, an exhaust slit 30 (refer to FIG. 5) is provided to exhaust air from the inside of base housing part 28.

At a position which is on the side surface on the downstream side in the sub-scanning direction Y, and corresponding to the outside air feeding port 29, a base cooling fan 31 (refer to FIG. 3 and FIG. 5) is provided, as the base temperature adjusting device. The base cooling fan 31 rotates to feed the outside air from the outside air feeding port 29 and exhaust the air through the exhaust slit 30, thereby releasing the heat and cooling the base part 19. This base cooling fan 31 is structured in such a manner that, when the voltage applied on a drive motor for driving the fan is changed, the rotation speed can be changed.

Figure 5:
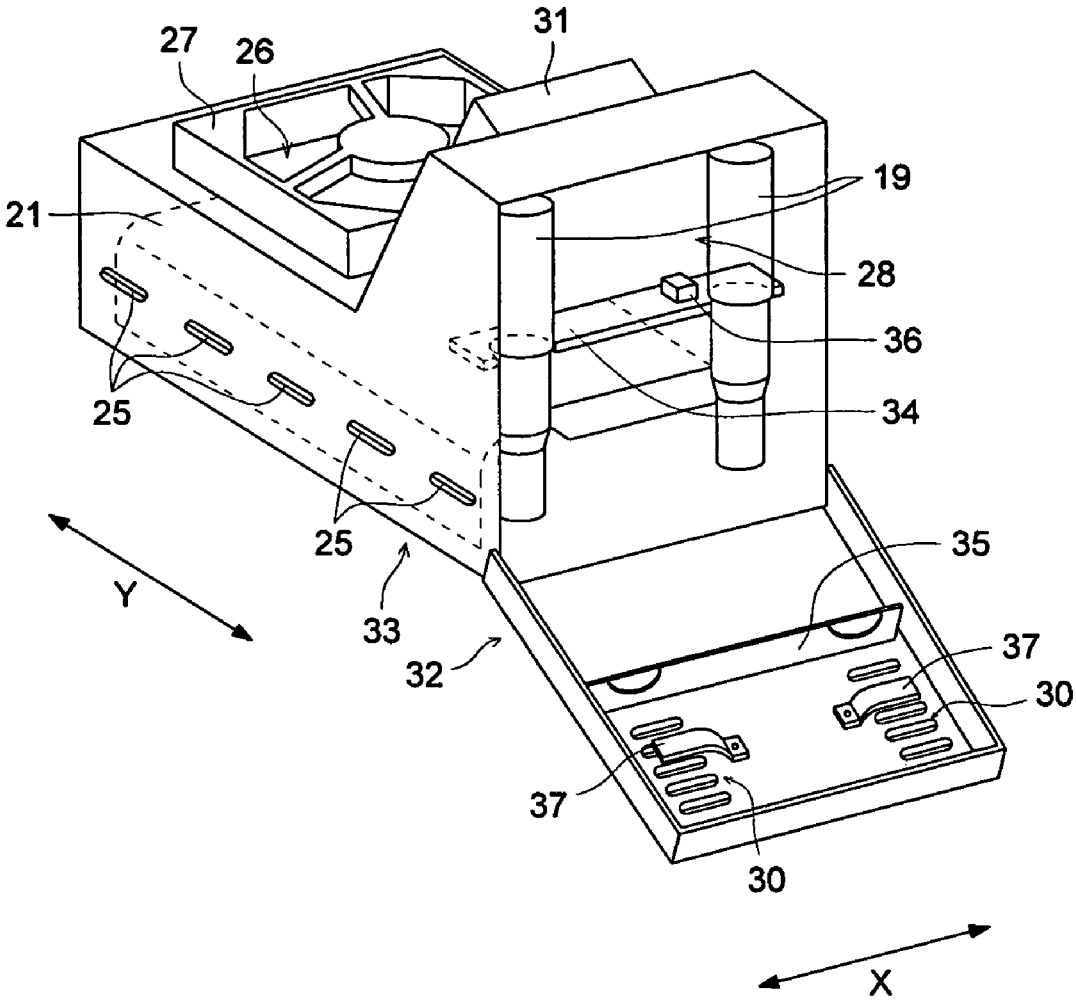
FIG. 5 is a perspective view from upstream side in a sub scanning direction, showing the structure of the ultraviolet ray irradiating device provided in the inkjet recording apparatus in FIG. 1.

The side surface on the upstream side in the sub-scanning direction Y of the cover member 16 is, as shown in FIG. 5, structured in such a manner that, when a cover part 32 is rotated by making the bottom as the axis, to the main body part 33 in which the low pressure mercury lamp 17 is housed, the side surface can be opened and closed. Between the light emitting tube housing part 20 and the base housing part 28 in the main body part 33, a plate-like main body side partition member 34, having the heat insulating property, and for separating both parts, is provided so as to be brought into contact with the peripheral surface on the upstream side in the sub-scanning direction Y of the end part of the base part 19 on the light emitting tube 18 side. Further, at a position corresponding to the main body side partition member 34 of the cover part 32, a plate-like cover side partition member 35 having the heat insulation property is provided to separate the light emitting tube housing part 20 and the base housing part 28 in such a manner that it can be brought into contact with the upstream side peripheral surface in the sub-scanning direction Y of the end part of the base part 19 on the light emitting tube 18 side. The main body side partition member 34 and the cover side partition member 35 are arranged in such a manner that, when the cover part 32 is closed to the main body part 33, they are combined, and thus a partition member is structured to separate the light emitting tube hosing space 20 and the base hosing space 28.

Further, at a position which is above the main body side partition member 34 and in the vicinity of the base part 19, a base temperature sensor 36 is provided as a base temperature detection device to detect the temperature of the base part 19.

Further, at a position corresponding to the base part 19 of the cover part 32, a terminal 37 for supplying electric power to the base part 19 is provided which is brought into contact with the base part 19, when the cover part 32 is closed to the main body part 33, and thus high electric power is supplied to the base part 19 through this terminal 37. Hereby, because high illuminance ultraviolet ray is irradiated from the light emitting tube 18, without widely arranging the low pressure mercury lamp 17 in the main scanning direction X or sub-scanning direction Y, a predetermined light amount necessary for curing ink can be obtained.

Further, on the upper surface of the casing of the inkjet recording apparatus 1, a display unit 41 (refer to FIG. 6) which is constructed by, for example, a liquid crystal display is provided, as the reporting device for displaying various kinds of messages.

Figure 6:
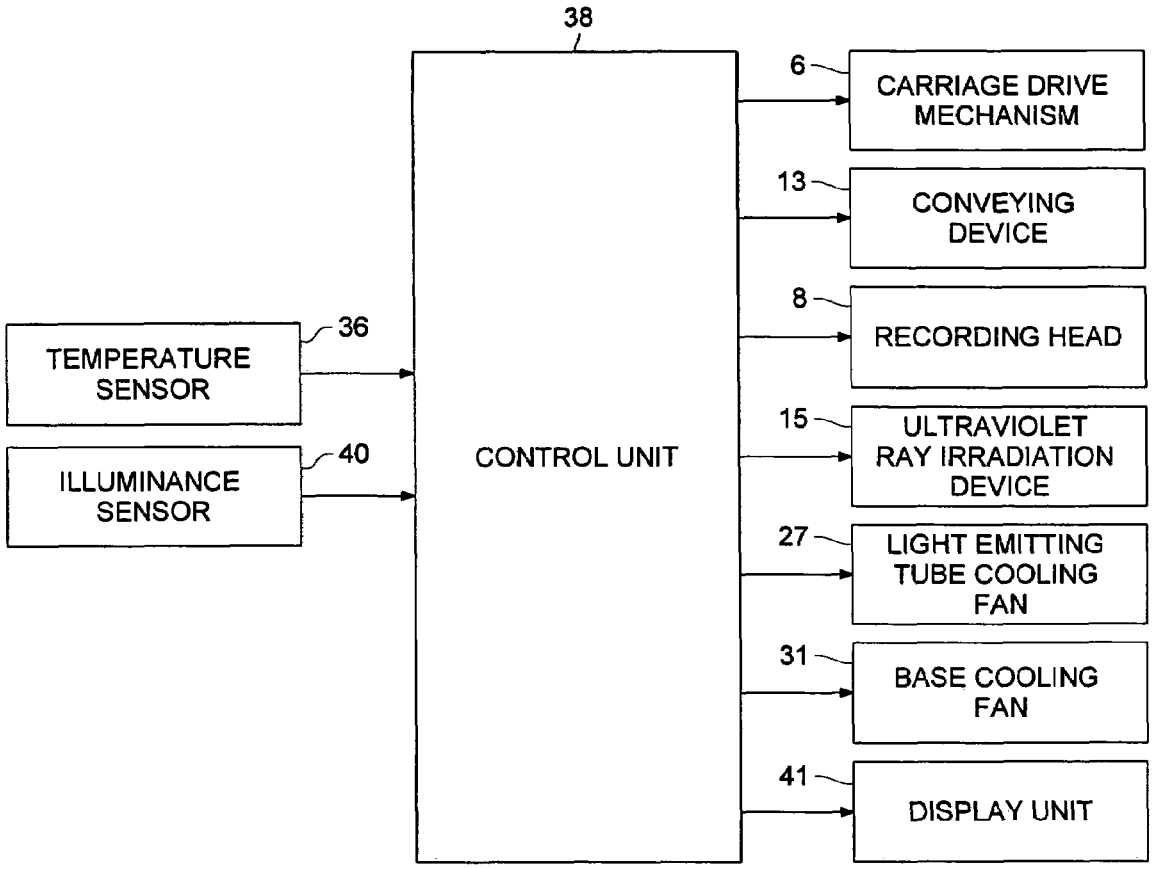
FIG. 6 is a block diagram showing the structure of the inkjet recording apparatus in FIG. 1.

FIG. 6 shows a control device for controlling the inkjet recording apparatus 1 in the present embodiment, and this control unit includes, for example, a CPU, RAM, ROM, (they are not shown), and a processing program recorded in the ROM is expanded into the RAM, and the control device has a control unit 38 for execution of this processing program by the CPU.

According to the processing program, this control unit 38 controls operations of members including the carriage drive mechanism 6, conveying device 13, recording head 8, ultraviolet ray irradiation device 15, light emitting tube cooling fan 27, base cooling fan 31, and display unit 41, based on the status such as their respective operation conditions.

Particularly, in the inkjet recording apparatus 1, the base temperature sensor 36 is connected to the control unit 38, and the control unit 38 controls, corresponding to the detection result of the base temperature sensor 36, the rotation speed of the base cooling fan 31 so that the temperature of the base part 19 comes into a predetermined range.

Because a low output light source has a characteristic that makes a difference in the ultraviolet ray generation energy, depending on the temperature of the base part 19. Therefore, the temperature, of the base part 19, at which ultraviolet ray is generated in a condition of high light emitting efficiency may be previously found, and the base part 19 may be controlled to maintain the temperature. The temperature, of the base part 19, at which the light emitting efficiency is high changes with a current value flowing in the base part 19. In the case where the output is stable and the light emitting efficiency becomes high when the temperature is, for example, 40±5° C., it is preferable that the rotation speed of the base part cooling fan 31 is controlled so that the temperature of the base part 19 becomes 40±5° C. Therefore, for example, when the temperature of the base part 19 exceeds 45° C., rotation speed is preferably raised, and when the temperature of the base part 19 is not lower than 40° C. and not higher than 45° C., the rotation speed is preferably lowered.

Further, in performing recording operation, the control unit 38 drives the light emitting tube cooling fan 27 to rotate it after a predetermined time period elapses from when the low pressure mercury lamp 17 is turned on, and when the recording operation is terminated and the low pressure mercury lamp 17 is turned off, the rotation of the light emitting tube cooling fan 27 is stopped.

A low output light source like the low pressure mercury lamp 17 has a characteristic that the ultraviolet generation energy changes also with the temperature difference between the base part 19 and the light emitting tube 18. Therefore, under a condition that the base part 19 is maintained at a temperature at which the light emitting efficiency is high, it is preferable to find a proper temperature of the light emitting tube 18 at which the temperature difference between the base part 19 and the light emitting tube 18 achieves a high and stable light emitting efficiency, and to find, in advance, a time period from when the low pressure mercury lamp 17 is turned on until the temperature of the light emitting tube 18 exceeds the upper limit of the proper temperature. Herein, preferably, the light emitting tube cooling fan 27 is to start rotation after this time period. Hereupon, in general, regarding the low pressure mercury lamp 17, the proper temperature of the light emitting tube 18 has a certain range. Therefore, it is preferable to rotate the light emitting tube cooling fan 27 at a rotation speed such that the temperature of the light emitting tube 18 is in the proper temperature range, in relationship with the rate of the temperature rise of the light emitting tube 18.

Further, to the control unit 38, an illuminance sensor 40 is connected, and the control unit 38 is structured in such a manner that, under the condition that the light emitting tube 18 and base part 19 are respectively adjusted to be in a predetermined range of temperature by the light emitting tube cooling fan 27 and the base cooling fan 31, the control unit 38 controls the illuminance sensor 40 to detect the illuminance of the light emitted from the light emitting tube 18. After the light is turned on, the illuminance of light emitted by the light emitting tube 18 rises for a certain time with a rise in the temperature of the light source, and then stabilizes. Therefore, first, the illuminance is intermittently detected to detect the stabilization state of the illuminance, an illuminance-change-rate calculating device calculates the illuminance-change-rate, and then, when the illuminance-change-rate has come into a range of a predetermined value, the illuminance-change-rate calculating device determines that the illuminance has reached a peak. The predetermined value is to be set, for example, to ±10% or smaller, and preferably, to ±5% or smaller. Herein, the periodical time of detecting the illuminance is to be set, for example, to 30 seconds or shorter, and preferably, to 10 seconds or shorter. Thus, it is determined that the illuminance has been stabilized. Then, if the detected illuminance is higher than the reference value and not higher than a predetermined value, the control unit 38 determines the illuminance has dropped, and controls the display unit 41 to display a massage informing this status and the necessity of replacing the light source shortly. Further, when the illuminance detected by an illuminance sensor 40 is not higher than the reference value, the control unit 38 determines that the ink can not be cured due to the deterioration of the low pressure mercury lamp 17, and makes the display unit 41 display a massage informing this status and prompting for replacement of the low pressure mercury lamp 17, and controls each unit in order to prohibit image recording.

As a reference value, illuminance is preferably to be set to a value with which ink cannot be cured well, for example, 70% of an initial value. Further, a predetermined value of illuminance is preferably set to a value at which a message is displayed at a timing effective for notifying the user that the low pressure mercury lamp 17 needs to be replaced shortly due to its life.

Next, the operation of the inkjet recording apparatus 1 in the present embodiment will be described.

When the image recording operation is started, the low pressure mercury lamp 17 of the ultraviolet irradiation apparatus 15 is turned on, and high electric power is supplied to the base part. Accordingly, the temperatures of the base part 19 and the light emitting tube 18 rise. However, when a predetermined time elapses after the low pressure mercury lamp 17 has been turned on, the rotation of the light emitting tube cooling fan 27 starts rotation, and the light emitting tube 18 is cooled. Thus, the temperature difference between the light emitting tube 18 and the base part 19 is adjusted to be within a range of temperature difference where the light emitting efficiency is high.

Further, the temperature of the base part 19 is detected on occasion by the base temperature sensor 36, and based on the detected temperature, the rotation speed of the base cooling fan 31 is controlled by the control unit 38, and the temperature of the base part 19 is adjusted to be within a predetermined range.

In this manner, the temperatures of the base part 19 and the light emitting tube 18 are individually adjusted, and under the condition that the light emitting efficiency of the low pressure mercury lamp 17 is maintained most sufficiently, the luminance of the ultraviolet ray emitted by the light emitting tube 18 is detected by the illuminance sensor 40. Herein, after the light emitting tube 18 starts lighting, the illuminance-change-rate is calculated by an illuminace-change-rate calculating device, based on illuminances detected intermittently at a constant interval. When the illuminace-change-rate has converged into a predetermined range, the control unit 38 determines whether the detected illuminance is not higher than the reference value.

When the illuminance is not higher than the reference value, the control unit 38 determines that ink cannot be cured well, and the display unit 41 displays this status and a massage which prompts for replacement of the low pressure mercury lamp 17. In this manner, when the illuminance is not higher than the reference value even under an optimum condition for the light emitting efficiency of the low pressure mercury lamp 17, this massage is displayed, and the user replaces the low pressure mercury lamp 17. Thus, the ultraviolet ray of an illuminance suitable for curing ink is always emitted from the low pressure mercury lamp 17.

On the one hand, when the illuminance is higher than the reference value, the control unit 38 determines whether the illuminance is not higher than the predetermined value. When the illuminance is not higher than the predetermined value, the display unit 41 displays a massage that the illuminance has dropped and the low pressure mercury lamp 17 needs to be replaced shortly, which draws user's attention.

After that, when the recording medium 7 is conveyed in the conveying direction Y by the conveying device 13, and arrives at a predetermined position of the platen 14, the carriage 5 reciprocally moves along the guide rail 4 and ink is ejected from the nozzles of the recording heads 8 based on certain image data. On the ink ejected onto the recording medium 7, ultraviolet ray of an illuminance higher than the reference value is irradiated and the ink is cured and fixed. Thus, an image is recorded on the recording surface of the recording medium 7.

Further, during image recording, the illuminance of ultraviolet ray is periodically detected by the illuminance sensor 40, and the control unit 38 determines whether the detected illuminance is higher than the reference value and whether higher than the predetermined value. When it is not higher than the reference value, the display unit 41 displays a message that ink cannot be cured well, prompting for replacement of the low pressure mercury lamp 17. When the illuminance is higher than the reference value, and not higher than a predetermined value, the display unit 41 displays a message informing that the illuminance has dropped, and the low pressure mercury lamp 17 needs to be replaced shortly. Hereby, onto ink ejected on the recording medium 7, the ultraviolet ray of an illuminance higher than the reference value is always emitted.

As stated above description, in the inkjet recording apparatus 1, the optimum light emitting efficiency is maintained by adjusting the temperature of the base part 19 and the light emitting tube 18, under the condition that the low pressure mercury lamp 17 is not deteriorated. When the low pressure mercury lamp 17 is deteriorated, the life of the low pressure mercury lamp 17 is correctly determined by the control unit 38, and this status is displayed on the display unit 41. Therefore, ultraviolet ray of an illuminance appropriate for curing ink is always irradiated, without placing a load on the user, the ink is cured well, and high quality images can be obtained.

In the present embodiment, the reporting device is constructed by the display unit 41, and when the illuminance of the ultraviolet ray emitted from the low pressure mercury lamp 17 is not higher than the reference value or not higher than the predetermined value, respective massages are displayed on the display unit 41 by the control unit 38. However, it is not limited to this and, for example, an audio output device may be provided as the reporting device to output a sound of an alarm buzzer or a message. Further, an alarm lamp may be provided as the reporting device to emit light. Yet further, it is also possible that the display unit 41 displays a message, and in addition, a sound output device outputs a sound, or an alarm lamp emits light.

Further, in the present embodiment, when the illuminance of ultraviolet ray is not higher than the reference value, a massage is displayed on the display unit 41, and image recording is prohibited. However, it is also allowed that the apparatus only displays a message or only prohibits image recording.

Further, in the present embodiment, the temperatures of the base part 19 and the light emitting tube 18 are respectively adjusted to temperatures at which the light emitting efficiency of the low pressure mercury lamp 17 is high. However, for example, in a case where the temperature of the light emitting tube 18 cannot rise to a degree where cooling is necessary, it is also possible to increase the dimension of the low pressure mercury lamp 17 in the main scanning direction X, without supplying high voltage to the low pressure mercury lamp 17, to secure the light amount necessary for curing of ink, adjusting only the temperature of the base part 19.

Further, in the present embodiment, the rotation speed of the base cooling fan 31 is variable, and the rotation speed is controlled, based on the temperature of the base part 19. However, it is also allowed that the rotation speed is constant and the rotation and stoppage of the base cooling fan 31 are controlled based on the temperature of the base part 19 in such a manner that when the temperature of the base part 19 is high, the base cooling fan 31 is rotated, and when the temperature is low, the rotation is stopped. Furthermore, without controlling rotation speed or ON/OFF of the rotation, the base cooling fan 31 may also be rotated at a constant speed during image recording. In this case, in the relationship with the rate of temperature rise of the base part 19, it is also possible to rotate the base cooling fan 31 at a rotation speed such that the temperature of the base part 19 is in a range where output is stable and the light emitting efficiency is high.

Further, it is also possible to provide a light emitting tube temperature sensor, as a light emitting tube temperature detection device for detecting the temperature of the light emitting tube 18 in the vicinity of the light emitting tube 18, in order to control the rotation and stoppage of the light emitting tube cooling fan 27, based on the temperature of the light emitting tube 18. Alternatively, the rotation speed of the light emitting tube cooling fan 27 may be set to be variable, and the control unit 38 may also control the rotation speed of the light emitting tube cooling fan 27, based on the temperature of the light emitting tube 18, as the light emitting tube temperature detection device. Further, it is also possible to provide a temperature sensor for detecting the temperature of the reflection member 21 on one surface of the reflection member 21, and control the rotation of the light emitting tube cooling fan 27, based on the temperature of the reflection member 21.

Furthermore, in the present embodiment, the cooling fan is used as the base temperature adjusting device and light emitting tube temperature adjusting device. However, the base temperature adjusting device and light emitting tube temperature adjusting device are not limited to these.

For example, a Peltier module in which a plurality of Peltier elements, which are thermoelectric cooling elements, are electrically serially connected, may be provided through a thermal conduction member which is formed of high thermal conductivity material and covers the surround of two base parts 19. The Peltier module is formed in such a manner that, when DC current is flowed through the Peltier element from a power source unit, heat is absorbed from one surface of the Peltier element and released from the other surface. Preferably, the cooling surface and heating surface can be switched by changing the direction of the current flowing through the Peltier element. Further, it is possible to provide a heat sink on a surface facing a contact surface in contact with the thermal conduction part of the Peltier module to release the heat, which is absorbed from a cooling surface and transferred when the contact surface in contact with the thermal conduction part functions as the cooling surface. A cooling fan for releasing the heat radiated from the heat sink can be provided above the heat sink.

Then, in order to make the temperature of the base part 19 to be a temperature at which output is stable and light emitting efficiency is high, when the temperature of the base part 19 is high, the control unit 38 may control the power source unit to flow DC current through the Peltier element in the direction with which the contact surface in contact with the thermal conduction part of the Peltier module function as a cooling surface, rotating the cooling fan. When the temperature of the base part 19 is low, the control unit 38 may control the power source unit to flow DC current through the Peltier element in the direction with which the contact surface in contact with the thermal conduction part of the Peltier module functions as a heating surface.

In the same manner, in place of the light emitting tube cooling fan 27, the Peltier module may be provided above the reflection member 21 through a plate-like thermal conduction part formed of a material of high thermal conductivity, and the thermal transfer by the Peltier module may be controlled based on the temperature of the light emitting tube 18. Thus, when the temperature of the reflection member 21 is adjusted, the temperature of the light emitting tube 18 is adjusted.

Further, a water jacket in contact with the base part 19 and a water cooling tank for supplying cooling water to the water jacket may be provided to supply cooling water. In this case, temperature can be adjusted by controlling the supply flow rate of the cooling water. In the same manner, a water jacket may be provided on the upper surface of the reflection member 21, to adjust the temperature of the light emitting tube 18 by supplying cooling water.

Further, in the present embodiment, the control unit 38, which controls each part of the inkjet recording apparatus 1, controls the rotation speed of the base cooling fan 31, to serve as base temperature control device. However, a micro-computer, for example, may be provided in the casing of the base cooling fan 31, and this micro-computer may control the rotation speed, to serve as base temperature control device.

Further, in the present embodiment, the serial head type inkjet recording apparatus 1 for image recording is applied in such a manner that, while the recording heads 8 mounted on the carriage 5 reciprocally move in the main scanning direction X and the recording medium 7 is conveyed in the sub scanning direction Y, the apparatus jets ink from the recording heads 8. However, the invention can also be applied to a line head type inkjet recording apparatus which records an image in such a manner that ink is jetted from recording heads 8 which are provided over the entire width of a recording medium 7 and fixed above the recording medium 7, and the recording medium 7 is conveyed in the direction perpendicular to the recording heads 8.

Further, in the present embodiment, image recording is performed by using ink which is cured by irradiating ultraviolet ray. However, ink to be employed is not always limited to this, but may also be ink which is cured by irradiating light, other than ultraviolet ray, such as electron ray, X-ray, visible ray, or infrared ray. In this case, applied are a polymerization compound which is polymerized and cured by light other than ultraviolet ray, and a light initiator which initiates polymerization reaction of the mutual polymerization compounds with light other than ultraviolet ray. Further, in the case of using light curable ink which is cured by light other than ultraviolet ray, a light source which irradiates this light is applied instead of an ultraviolet light source.

Still further, although, in the present embodiment, a low pressure mercury lamp is used, the invention is not limited to this, and various types of light sources such as a high pressure mercury lamp can also be employed.

The invention includes the following structures.

(1) An inkjet recording apparatus includes a recording head formed with nozzles for jetting light curable ink onto a recording medium, a light irradiator having a light source for emitting light to cure the ink, and an illuminance detecting device for intermittently detecting an illuminance of the light emitted from the light source, at a predetermined interval.

(2) The inkjet recording apparatus of item (1) further includes an illuminance-change-rate calculating device for calculating an illuminance-change-rate between intermittent detections of illuminance.

(3) In the inkjet recording apparatus of item (2), the illuminance-change-rate calculating device determines that the illuminance has reached a peak, if the illuminance-change-rate is within a predetermined range of value.

(4) The inkjet recording apparatus of item (3) performs illuminance detection before starting image recording.

According to items (1) to (4), it is possible to prevent starting image recording with an illuminance in an unstabilized condition or incorrectly determining that the illuminance is too low and the light source is no longer usable. Accordingly, it is possible to determine the illuminance of light emitted by the light source, in a stabilized condition, start image recording in a stabilized illuminance, or correctly determine that the light source is no longer usable.

(5) In the inkjet recording apparatus of item (1), an illuminance sensor of the illuminace detecting device is covered by a light shielding member while the illuminance detecting device is not detecting the illuminance.

According to item (5), the illuminance sensor is covered by the light shielding member when the sensor does not detect the illuminance during intermittent illuminance detection, which reduces deterioration of the sensor due to exposure to light, and makes the life of the sensor longer.

(6) The inkjet recording apparatus of item (1) further includes a temperature adjusting device for adjusting a temperature of the light source, and a control unit for determining that the ink cannot be cured, if the illuminance detected by the illuminance detecting device is not higher than a reference value in a condition where the temperature of the light source has been adjusted into a predetermined range by the temperature adjusting device.

(7) The inkjet recording apparatus of item (6) further includes a reporting device for reporting a result determined by the control unit to a user, wherein, when the control unit has determined that the ink cannot be cured, the control unit controls the reporting device to report that the ink cannot be cured.

(8) The inkjet recording apparatus of item (6) further includes a temperature detecting device for detecting the temperature of the light source, wherein the control unit controls the temperature adjusting device such that the temperature of the light source comes into a predetermined range, based on the temperature of the light source detected by the temperature detecting device.

According to items (6) to (8), it is possible to prevent starting image recording with an illuminance in an unstabilized condition or incorrectly determining that the illuminance is too low and the light source is no longer usable. It is possible to determine the illuminance of light emitted by the light source, in a stabilized condition, start image recording in a stabilized illuminance, or correctly determine that the light source is no longer usable. Further, the temperature of the light source can be adjusted. If the temperature is adjusted to a temperature at which the light emitting efficiency of the light source becomes optimum, an illuminance suitable for curing of ink is always maintained on condition that the light source is not deteriorated. When the light source is deteriorated, the illuminance drops equal to or lower than a reference value and the control unit determines that ink cannot be cured, even if the temperature of the light source is adjusted.

(9) An inkjet recording apparatus is provided with a recording head formed with nozzles to eject ink, which is cured by irradiating light, onto a recording medium, a light irradiating device provided with a light source for emitting light to cure the ink, temperature adjusting device for adjusting the temperature of the light source, illuminance detection device for detecting the illuminance of the light irradiated from the light source, and control unit for determining that the ink can not be cured when the illuminance detected by the illuminance detection device is not higher than a reference value in a condition that the temperature of the light source is adjusted to a temperature within a predetermined range by the temperature adjusting device.

According to item (9), the temperature of the light source can be adjusted. If the temperature is adjusted to a temperature at which the light emitting efficiency of the light source becomes optimum, an illuminance suitable for curing of the ink is always maintained on condition that the light source is not deteriorated. When the light source is deteriorated, the illuminance drops equal to or lower than a reference value and the control unit determines that ink cannot be cured, even if the temperature of the light source is adjusted.

(10) The inkjet recording apparatus of item (9) further includes a reporting device for reporting the determined result by the control unit to the user, and when the control unit determines that the ink cannot be cured, the determined result is reported to the reporting device.

According to item (10), in the case where the light source is deteriorated, the illuminance drops equal to or lower than the reference value even in the condition that the temperature of the light source is adjusted, and it is determined by the control unit that the ink can not be cured, the determined result informing this status is reported by the reporting device. Therefore, it is not necessary that the user determines whether the drop in the illuminance is due to the life of the light source, or due to a drop in the light emitting efficiency.

(11) In the inkjet recording apparatus of item (10), the reporting device is a display unit for displaying the determined result by the control unit.

According to item (11), in the case where the light source is deteriorated, the illuminance drops equal to or lower than the reference value even in the condition that the temperature of the light source is adjusted, and it is determined by the control unit that the ink can not be cured, the determined result informing this status is displayed by the display unit. Therefore, it is not necessary that the user determines whether the drop in the illuminance is due to the life of the light source, or due to a drop in the light emitting efficiency.

(12) The inkjet recording apparatus of any one of items (9) to (11), the control unit prohibits image recording when it is determined by the control unit that the ink cannot be cured.

According to item (12), in the case where the light source is deteriorated, the illuminance drops equal to or lower than the reference value even in the condition that the temperature of the light source is adjusted, and it is determined by the control unit that the ink can not be cured, image recording is prohibited. Therefore, the user is not required to determine whether the drop in the illuminance is due to the life of the light source or due to the drop in the light emitting efficiency.

(13) In the inkjet recording apparatus of any one of items (9) to (12), when the illuminance detected by the illuminance detecting device is higher than the reference value and not higher than a predetermined value, the control unit determines that the illuminance has dropped, and the determined result of this status is reported to the reporting device.

According to item (13), it can be reported to the user that the illuminance has dropped and the light source needs to be replaced shortly due to its life.

(14) The inkjet recording apparatus of any one of items (9) to (13) further includes a temperature detecting device for detecting the temperature of the light source, and the control unit controls, based on the temperature of the light source detected by the temperature detecting device, the temperature adjusting device so that the temperature of the light source comes into a predetermined range.

According to item (14), the temperature of the light source is adjusted based on the detected temperature. Therefore, under the condition that the light source is not deteriorated, the temperature of the light source can be more surely adjusted to a temperature at which the light emitting efficiency is stabilized, and an illuminance suitable for curing of the ink is always maintained.

(15) In the inkjet recording apparatus of any one of items (9) to (14), the light source is a low pressure mercury lamp that discharges electricity at the base part and emits light for curing ink with a light emitting tube.

According to item (15), the temperature of the low pressure mercury lamp can be adjusted. Therefore, when it is adjusted to a temperature at which the light emitting efficiency of the low pressure mercury lamp becomes optimum, an illuminance suitable for curing of the ink is always maintained on condition that the low pressure mercury lamp is not deteriorated. When the low pressure mercury lamp is deteriorated, the illuminance drops even in a condition that the temperature of the low pressure mercury lamp is adjusted, and the control unit determines that the ink cannot be cured.

(16) In the inkjet recording apparatus of item (14), the temperature detecting device detects the temperature of the base part, and the control unit controls, based on the temperature of the base part detected by the temperature detecting device, the temperature adjusting device so that the temperature of the base part come into a predetermined range.

According to item (16), the temperature of the base part is adjusted based on the detected temperature of the base part. Therefore, in a condition that the low pressure mercury lamp is not deteriorated, since the temperature of the base part can be more surely adjusted to a temperature at which the light emitting efficiency is stabilized, an illuminance suitable for curing of the ink is always maintained.

(17) The inkjet recording apparatus of item (14) further includes, as the temperature detecting device, a base temperature detecting device for detecting the temperature of the base part and a light emitting tube temperature detecting device for detecting the temperature of the light emitting tube, and as the temperature adjusting device, a base temperature adjusting device for adjusting the temperature of the base part and a light emitting tube adjusting device for adjusting the temperature of the light emitting tube. Based on the temperatures of the base part and the light emitting tube respectively detected by the base temperature adjusting device and the light emitting tube adjusting device, the control unit controls the base temperature adjusting device and the light emitting tube adjusting device so that the temperatures of the base part and the light emitting tube come into respective predetermined ranges.

According to item (17), the temperatures of the base part and the light emitting tube are respectively adjusted based on the respective detected temperatures of the base part and the light emitting tube. Therefore, on condition that the low pressure mercury lamp is not deteriorated, the temperature of the base part is more assuredly adjusted to a temperature at which the light emitting efficiency is stabilized, and the temperature of the light emitting tube can be adjusted so that the light emitting efficiency of the light source is stabilized, in the relationship of the temperature difference between the light emitting tube and the base part. Thus, an illuminance suitable for curing of the ink is always maintained.

(18) In the inkjet recording apparatus of any one of items (1) to (17), the ink is a cation polymerizable ink including a cation polymerizable compound.

According to item (18), the temperature of the light source can be adjusted. Therefore, when it is adjusted to a temperature at which the light emitting efficiency of the light source is optimum, an illuminance suitable for curing of the cation polymerizable ink is always maintained on condition that the light source is not deteriorated. When the light source is deteriorated, the illuminance drops equal to or lower than the reference value even in a condition that the temperature of the light source is adjusted, and the control unit determines that the cation polymerizable ink cannot be cured.

According to items (1) to (4), it is possible to prevent starting image recording with an illuminance in an unstabilized condition or incorrectly determining that the illuminance is too low and the light source is no longer usable. Accordingly, it is possible to determine the illuminance of light emitted by the light source, in a stabilized condition, start image recording in a stabilized illuminance, or correctly determine that the light source is no longer usable.

According to item (5), the illuminance sensor is covered by the light shielding member when the sensor does not detect the illuminance during intermittent illuminance detection, which reduces deterioration of the sensor due to exposure to light, and makes the life of the sensor longer.

According to items (6) to (8), it is possible to prevent starting image recording with an illuminance in an unstabilized condition or incorrectly determining that the illuminance is too low and the light source is no longer usable. It is possible to determine the illuminance of light emitted by the light source, in a stabilized condition, start image recording in a stabilized illuminance, or correctly determine that the light source is no longer usable. Further, the temperature of the light source can be adjusted. If the temperature is adjusted to a temperature at which the light emitting efficiency of the light source becomes optimum, an illuminance suitable for curing of ink is always maintained on condition that the light source is not deteriorated. When the light source is deteriorated, the illuminance drops equal to or lower than a reference value and the control unit determines that ink cannot be cured, even if the temperature of the light source is adjusted. According to item (9), by adjusting the temperature of the light source, an optimum light emitting efficiency is maintained on condition that the light source is not deteriorated. When the light source is deteriorated, the life of the light source is correctly determined by the control unit. Therefore, the light of a light amount suitable for curing of the ink is always irradiated to cure the ink well, without causing trouble for the user, and high quality images can be obtained.

According to item (10), by adjusting the temperature of the light source, an optimum light emitting efficiency is maintained on condition that the light source is not deteriorated. When the light source is deteriorated, the life of the light source is correctly determined by the control unit, and reported to the user. Therefore, the light of a light amount suitable for curing of the ink is always irradiated to cure ink well, without causing trouble for the user, and high quality images can be obtained.

According to item (11), when the temperature of the light source is adjusted, an optimum light emitting efficiency is maintained on condition that the light source is not deteriorated. When the light source is deteriorated, the life of the light source is correctly determined by the control unit and displayed on the display unit. Therefore, the light of a light amount suitable for curing of the ink is always irradiated to cure ink well, without causing trouble for the user, and high quality images can be obtained.

According to item (12), when the temperature of the light source is adjusted, an optimum light emitting efficiency is maintained on condition that the light source is not deteriorated. When the light source is deteriorated, the life of the light source is correctly determined by the control unit and image recording is prohibited. Therefore, the light of a light amount suitable for curing of the ink is always irradiated to cure ink well, without causing trouble for the user, and high quality images can be obtained.

According to item (13), it can be reported to the user that the illuminance has dropped and the light source needs to be replaced shortly due to its life.

According to item (14), the temperature of the light source is adjusted based on the detected temperature. Therefore, on condition that the light source is not deteriorated, the light of a light amount suitable for curing of the ink is always stably irradiated and the ink can be cured well, and as a result, high quality images can be stably obtained.

According to item (15), when the temperature of the low pressure mercury lamp is adjusted, the optimum light emitting efficiency is maintained on condition that the low pressure mercury lamp is not deteriorated. When the low pressure mercury lamp is deteriorated, the life of the low pressure mercury lamp is correctly determined by the control unit. Therefore, the light of a light amount suitable for the curing of the ink is always irradiated to cure ink well, without causing trouble for the user, and high quality images can be obtained.

According to item (16), the temperature of the base part is adjusted based on the detected temperature of the base part. Therefore, on condition that the low pressure mercury lamp is not deteriorated, the light of a light amount suitable for curing of the ink is always stably irradiated to cure ink well, and as the result, high quality images can be stably obtained.

According to item (17), the temperatures of the base part and the light emitting tube are adjusted based on the detected temperatures of the base part and the light emitting tube. Therefore, on condition that the low pressure mercury lamp is not deteriorated, the light of a light amount suitable for curing of the ink is always stably irradiated to cure the ink well, and as the result, high quality images can be stably obtained.

According to item (18), when the temperature of the light source is adjusted, an optimum light emitting efficiency is maintained on condition that the light source is not deteriorated. When the light source is deteriorated, the life of the light source is correctly determined by the control unit. Thereof, the light of a light amount suitable for curing of the cation polymerizable ink is always irradiated to cure the cation polymerizable ink well, and high quality images can be obtained.

What is claimed is:

1. An inkjet recording apparatus, comprising:

a recording head comprising nozzles for jetting light-curable ink onto a recording medium;

a light irradiator having a light source for emitting light to cure the ink, the light source having a base section to which electric power is supplied;

a base temperature detecting device which detects a temperature of the base section;

a temperature adjusting device for adjusting a temperature of the light source;

an illuminance detecting device for detecting an illuminance of the light emitted by the light source; and a control section which controls the temperature adjusting device to control the temperature of the base section to be within a predetermined range, based on the temperature of the base section detected by the base temperature detecting device, and which determines that the ink cannot be cured, if the illuminance detected by the illuminance detecting device is not higher than a reference value when the temperature of the base section has been adjusted to be in the predetermined range by the temperature adjusting device.

2. The inkjet recording apparatus of claim 1, further comprising a reporting device for reporting a result determined by the control section to a user, wherein, when the control section has determined that the ink cannot be cured, the control section controls the reporting device to report that the ink cannot be cured.

3. The inkjet recording apparatus of claim 2, wherein the reporting device comprises a display section for displaying the result determined by the control section.

4. The inkjet recording apparatus of claim 2, wherein the control section determines that the illuminance has dropped if the illuminance detected by the illuminance detecting device is higher than the reference value and not higher than a predetermined value, and the control section controls the reporting device to report that the illuminance has dropped.

5. The inkjet recording apparatus of claim 1, wherein the control section prohibits image recording if the control section has determined that the ink cannot be cured.

6. The inkjet recording apparatus of claim 1, wherein the light source comprises a low pressure mercury lamp that emits the light to cure the ink from a light emitting tube when the electric power is supplied to the base section.

7. The inkjet recording apparatus of claim 6, further comprising a light emitting tube temperature detecting device for detecting a temperature of the light emitting tube;

wherein the temperature adjusting device comprises a base temperature adjusting device for adjusting the temperature of the base section and a light emitting tube temperature adjusting device for adjusting the temperature of the light emitting tube; and wherein the control section controls the base temperature adjusting device and the light emitting tube temperature adjusting device such that the temperatures of the base section and the light emitting tube are within respective predetermined ranges, based on the respective temperatures of the base section and the light emitting tube detected by the base temperature detecting device and the light emitting tube temperature detecting device.

8. The inkjet recording apparatus of claim 7, wherein the control section determines that the ink cannot be cured, if the illuminance detected by the illuminance detecting device is not higher than the reference value when the respective temperatures of the base section and the light emitting tube have been adjusted to be in the respective predetermined ranges by the base temperature adjusting device and the light emitting tube temperature adjusting device.

9. The inkjet recording apparatus of claim 1, wherein the ink is cation polymerizable ink containing a cation polymerizable compound.

* * * * *